United States Patent [19]

Berliner

[11] Patent Number: 4,808,142

[45] Date of Patent: Feb. 28, 1989

[54] DOLL WITH CONTROLLED MOUTH ACTUATION IN SIMULATED SPEECH

[75] Inventor: William Berliner, Essex, Conn.

[73] Assignee: Coleco Industries, Inc., West Hartford, Conn.

[21] Appl. No.: 11,833

[22] Filed: Feb. 6, 1987

[51] Int. Cl.[4] ..... A63H 3/28

[52] U.S. Cl. ..... 446/301; 446/353

[58] Field of Search ..... 446/175, 297, 298, 299, 446/300, 301, 302, 303, 353; 40/416, 455, 457

[56] References Cited

U.S. PATENT DOCUMENTS

| | | | |
|---|---|---|---|
| 2,514,450 | 7/1950 | Kopf | 446/270 |
| 3,060,631 | 10/1962 | Collischan | 446/301 |
| 3,199,248 | 8/1965 | Suzuki | 446/299 |
| 3,293,794 | 12/1966 | Ryan | 446/299 |
| 3,315,406 | 4/1967 | Ryan | 446/299 |
| 3,331,463 | 7/1967 | Kramer | 446/353 |
| 3,364,618 | 1/1968 | Kyan et al. | 446/301 |
| 3,495,351 | 2/1970 | Bear et al. | 446/299 |
| 3,662,374 | 5/1972 | Harrison, III et al. | 446/301 |
| 3,745,696 | 7/1973 | Sapkus et al. | 446/338 |
| 3,828,469 | 8/1974 | Giroud | 446/337 |
| 4,139,968 | 2/1979 | Milner | 446/301 |
| 4,207,704 | 6/1980 | Akiyama | 446/301 |
| 4,294,033 | 10/1981 | Terzian | 446/190 |
| 4,318,245 | 3/1982 | Stowell et al. | 446/484 |
| 4,389,811 | 6/1983 | Iwaya et al. | 446/193 |
| 4,484,408 | 11/1984 | Fogarty et al. | 446/299 |
| 4,514,883 | 5/1985 | Barbieri et al. | 446/28 |
| 4,516,950 | 5/1985 | Berman et al. | 446/299 |
| 4,571,208 | 2/1986 | Saigo et al. | 446/353 |
| 4,579,540 | 4/1986 | Ho | 446/301 |
| 4,579,541 | 4/1986 | Kuleza et al. | 446/304 |
| 4,665,640 | 5/1987 | Forsse et al. | 446/301 |
| 4,687,457 | 8/1987 | Milner | 446/303 |

FOREIGN PATENT DOCUMENTS

| | | | |
|---|---|---|---|
| 04184 | 12/1983 | PCT Int'l Appl. | 446/297 |
| 995974 | 6/1965 | United Kingdom | 446/301 |
| 2145935 | 4/1985 | United Kingdom | 446/298 |

*Primary Examiner*—Robert A. Hafer
*Assistant Examiner*—Charles H. Harris

[57] ABSTRACT

A doll head of flexible self-supporting material having lips and defining a mouth and a motor-driven mouth actuator which moves the lips between open and closed positions to simulate mouth movement and a central processing unit including a speech synthesizing system energizes the mouth actuator motor during synthesized speech, but does not de-energize the mouth actuator motor after a speech phrase until the mouth is in a closed position.

2 Claims, 2 Drawing Sheets

DOLL WITH CONTROLLED MOUTH ACTUATION IN SIMULATED SPEECH

FIELD OF THE INVENTION

This invention relates to an arrangement for synchronizing movement of a doll's mouth and lips with the utterance of synchronized speech from the doll.

BACKGROUND OF THE INVENTION

The prior art discloses various dolls, including sound generating equipment in which motion is imparted to the lips of the doll when the sound generating equipment is in operation. Examples of this prior art are U.S. Pat. Nos. 3,315,406, 3,828,469 and 4,294,033, which provide mechanisms to move two lips of the doll's head; U.S. Pat. No. 3,293,794; and U.S. Pat. No. 3,745,696.

These prior art constructions are rather complex and are not known to provide realistic movement of the mouth.

The movement of a doll's mouth during synthesized speech should be realistic and should coincide with the synthesized speech, and the mouth should be in a closed position when a synthesized speech phrase or sentence is completed. Accordingly, the present invention provides a new and improved arrangement for controlling movement of a doll's mouth during the utterance of synthesized speech.

SUMMARY OF THE INVENTION

Briefly stated, the invention, in one form thereof, comprises the combinaton of a doll head which may be in human configuration, or that of an animal, which is molded of a soft plastic material such as polyvinyl chloride, but which is generally self-supporting. The doll's head defines a nose with lips therebelow. The lips extend into a mouth portion having a roof and a base which are joined on the inside of the head. Disposed within the doll's head, is an actuating mechanism within a housing for moving the doll's lips. The actuating mechanism is driven by a motor and includes an oscillating lever which engages the lips and produces movement thereof. The speed system of the doll includes a speech synthesizer, a memory having speech data in digitally encoded form therein, together with encoded instructions for producing synthesized speech in accordance with stored programs. The system is under the control of a central processing unit (CPU) which decodes the stored data and applies it to the speech synthesizer. As speech is being synthesized into literal utterances, the motor is caused to operate by the CPU. At the end of a speech phrase or sentence, the lip actuating mechanism signals when the doll's lips are closed and the motor is de-energized.

An object of this invention is to provide a new and improved arrangement for controlling the time of movement of a doll's mouth when synthesized speech is uttered.

The features of the invention which are believed to be novel are particularly pointed out and distinctly claimed in the concluding portion of the specification. The invention, however, together with further objects and advantages thereof, may best be appreciated by reference to the following detailed description taken in conjunction with the drawings.

DETAILED DESCRIPTION OF THE ILLUSTRATED EMBODIMENT

The doll mouth actuator hereinafter described is the subject of copending Application Ser. No. 07/011,769 filed Feb. 2, 1987 filed concurrently with this application and now abandoned. The mouth actuator is a preferred one, however, this invention may be utilized in conjunction with other doll mouth actuating mechanisms.

Figure 1:
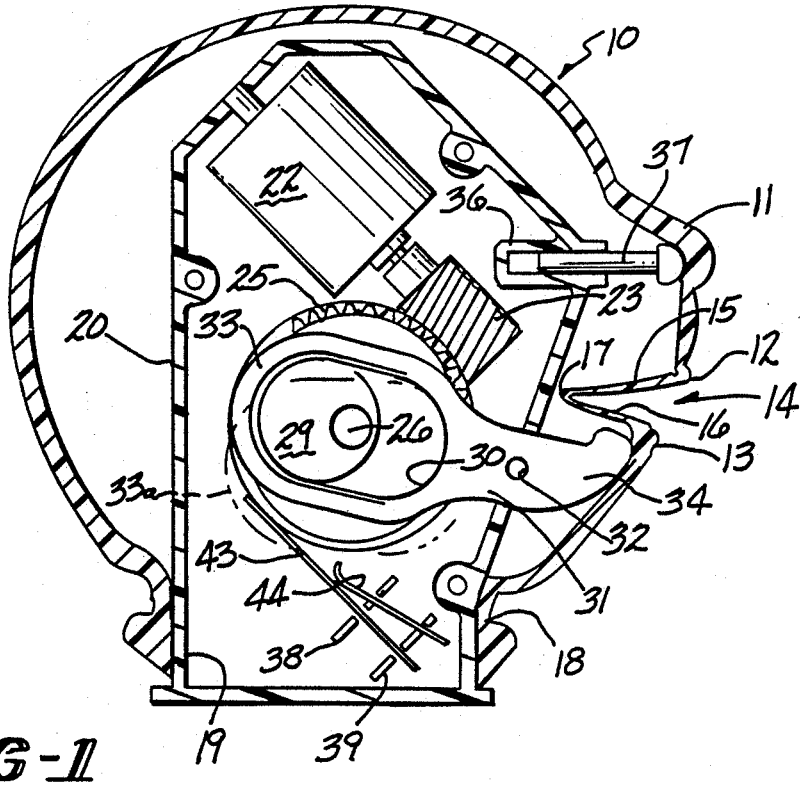
FIG. 1 is a sectional side elevation of a doll's head and the actuating mechanism for the mouth thereof, together with one-half of the housing for the mechanism.

Reference is made to FIG. 1 which exemplifies a doll's head which is molded of a soft plastic material such as polyvinyl chloride. The head 10 is molded with a simulated nose 11 below which are lips 12 and 13 which define a mouth 14 having an upper roof portion 15 and a lower base portion 16, which are joined within the simulated head at 17. The head 10 will also have eyes (not shown). Head 10 further includes an annular neck portion 18 which will engage a semi-annular portion 19 of a housing member 20. In FIG. 1, only one-half of the housing member is shown, together with the activating mechanism.

Figure 2:
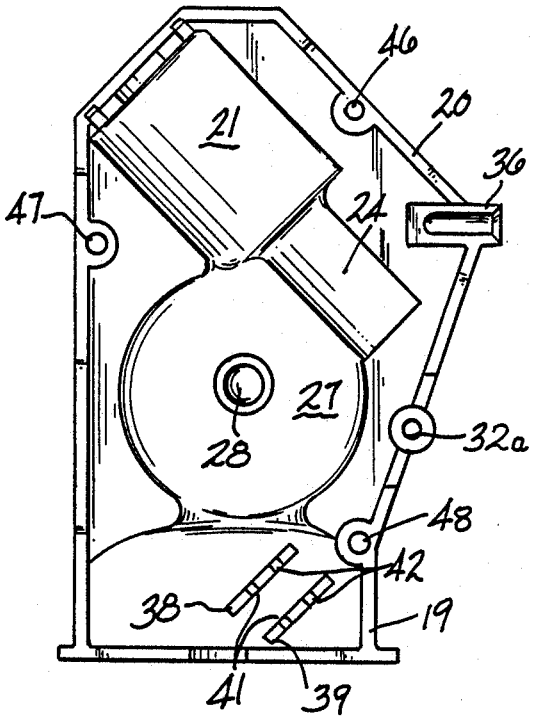
FIGS. 2 and 3 are interior elevation views of a two-part housing for the actuating mechanism.

Reference is now made to FIG. 2 in conjunction with FIG. 1. FIG. 2 illustrates housing member 20, as shown in FIG. 1. The housing member 20 is preferably of a molded plastic configuration and comprises a well 21 which receives a electric motor 22, as shown in FIG. 1. Motor 22 drives a worm 23 which is received in a well 24 in housing member 20. Worm 23 meshes with a gear 25 which is on a shaft 26, and gear 25 is received in a circular recess 27 defined in housing member 20. The shaft 26, upon which the gear 25 is positioned, is received in a bearing socket 28 in housing member 20.

An annular cam 29 is integral with gear 25 and is eccentric with respect to shaft 26. Both gear 25 and cam are rotatable on shaft 26. Alternately, both could be made fast on shaft 26. Cam 29 is received in a follower slot 30 of a lever 31. Lever 31 is a lever of the first class and is pivotally mounted intermediate its end to the housing by a pin 32 which is received in pivot rceptacles 32a on housing members 20 and 20a. Lever 31 has an interior end 33 which defines the follower slot 30, and an actuator end 34 which extends to the lower lip 13 of the doll head.

The housing member 20 further extends one-half of a cylinder 36 which receives a stabilizing pin 37 which defines to the doll's nose 11 on the interior of the head and is bonded thereto. This stabilizing pin 37 will prevent any residual movement of the nose when the mouth is actuated by lever arm 34. Pin 37 acts a a piston and may move in cylinder 36. This construction is provided to accept manufacturing tolerances in the molded head.

Integrally molded with housing member 20 are ribs 38 and 39, each defining spaced apart openings 41 and 42. The openings 41 and 42 frictionally receive switch contacts 43 and 44, respectively. The switch contacts 43 and 44 are arranged to be actuated by the interior end 33 of lever 31 when lever 31 is in a position to close the mouth 14. The switch contacts as shown are in a closed position. However, as lever 31 is rocked, it will move to the broken line position indicated at 33*a* and break electrical contact between contacts 43 and 44. This will signify that the lips 12 and 13 of mouth 14 are in a closed position. Alternatively, the contacts 43 and 44 may be in open position and then closed by end 33*a* of lever 31 when the mouth 14 is in a closed position.

Figure 3:
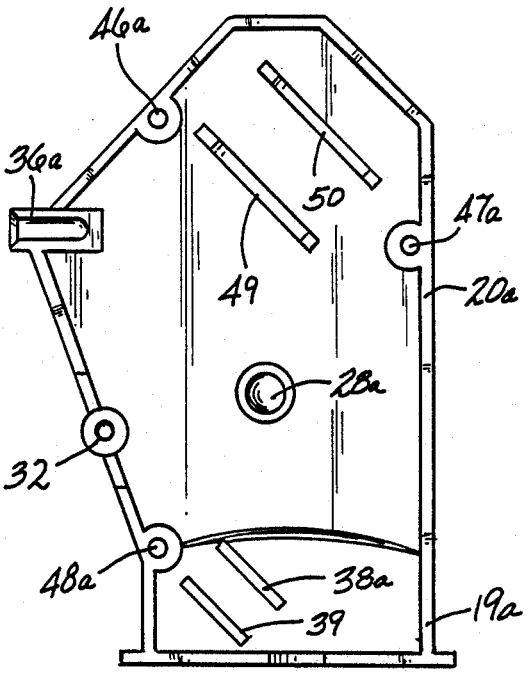

FIG. 3 shows the other half of the housing member and is identified by the reference numeral 20*a*. This half housing member 20*a* is also of a rigid molded plastic and the parts therein which are mating to the housing member 20 are identified by the same reference numeral with the suffix "a".

The halves of the housing member include mating apertures 46 and 46*a*, as shown in FIGS. 2 and 3, and 47 and 47*a* for receiving fasteners therethrough. Both define sockets 48 and 48a for receiving a locating pin.

The housing member 20*a* of FIG. 3 includes ribs 49 and 50 having arcuate surfaces which will clamp on to the cylindrical periphery of motor 22, and retain motor 22 in its socket 21.

Housing member 20*a* of FIG. 3 also has projections 38*a* and 39*a* which close the openings 41 and 42 in ribs 38 and 39. Housing member 20*a* has an annular periphery 19*a* adjacent the base thereof, which together with the periphery 19 of housing member 20, form an annulus to be received in the neck 18 of head 10.

Figure 4:
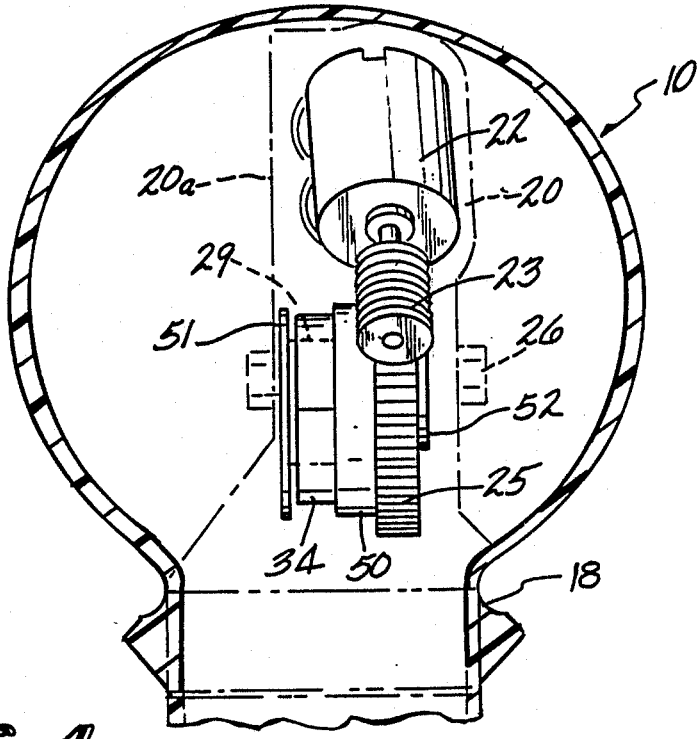
FIG. 4 is a sectional front elevation of the doll's head and the drive mechanism of FIG. 1, with the housing for the mechanism shown in broken line.

FIG. 4 represents a front elevation of the mechanism of FIG. 1 with the housing members 20 and 20*a* cut away. FIG. 4 illustrates the motor 22, worm gear 23, gear wheel 25, shaft 26, cam 29, and lever 34. FIG. 4 further shows a spacer 50 between gear 25 and lever 31. Thrust washers 51 and 52 are on shaft 26.

Figure 5:
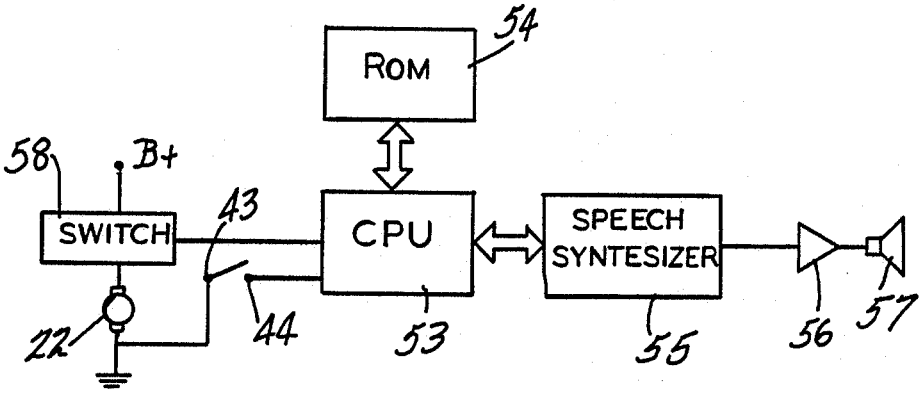
FIG. 5 is a diagram, partly schematic and partly in block form, of a speech synthesizing system embodying the invention.

FIG. 5, schematically and in block form, exemplifies the invention. The speech synthesis circuit contains a microprocessor 53 (central processing unit CPU) a read only memory 54, a speech synthesizer 55, an audio amplifier 56, and a speaker 57. Such a system is described in U.S. Pat. No. 4,331,836 assigned to Texas Instruments, Inc. In operation, the CPU 53 will control the operation of the speech synthesizer, deriving stored speech information from ROM 54 and supplying it to the speech synthesizer, which then synthesizes the speech information and supplies it to amplifier 56 and hence, to speaker 57. During the time of synthesized speech, CPU 53 will energize motor 22 from a source of B+ (batteries) through a switch 58. When the speech phrase or sentence is finished, and upon the next closing of mouth 14, contacts 43 and 44 will open (or close as the case may be) and supply a signal to CPU 53, and CPU 53 then operates switch 58 to deenergize motor 22 and cease movement of mouth 14. The CPU 53 will continue to drive the motor 22 as long as synthesized speech is called for. CPU 53 determines that there is not longer any synthesized speech being produced by the speech synthesizer and a signal to that effect is output to the CPU 53 when the contacts 43 and 44 are open or closed, as the case may be, to indicate that the mouth 14 is in a closed position, CPU 53 will deenergize motor 22, leaving the doll mouth 14 in a closed position. The doll mouth actuator will continue to operate upon cessation of synthesized speech until a signal is received from switch contacts 43 and 44 that the mouth is closed. The interim in between will be very small and an observer is not likely to notice the difference between the end of the synthesized speech and closure of the doll mouth 14.

It may thus be seen that the objects of the invention set forth, as well as those made apparent from the foregoing description, are efficiently attained. While a preferred embodiment of the invention has been set forth for purposes of disclosure, modifications to the disclosed embodiment of the invention, as well as other embodiments thereof, may occur to those skilled in the art. Accordingly, the appended claims are intended to cover all embodiments of the invention and modifications to the disclosed embodiment which do not depart from the spirit and scope of the invention.

Having thus described the invention, what is claimed is:

1. A doll having a hollow head with lips defining a mouth, said head being formed of an elastically deformable material, a lip actuating mechanism within said head connected to said lips to provide movement thereof between an open position and a closed position of said mouth, a speech synthesizing system within said doll including a central processing unit for causing speech to be synthesized, a motor operable by said central processing unit upon initiation of synthesized speech for driving said mechanism and causing said mouth to open and close when speech is being synthesized, and switch means operable by said mechanism when said mouth is moved to a closed position for providing a signal to said central processing unit, whereby said central processing unit is operable to terminate operation of said motor to cause said mouth to remain in closed position upon termination of synthesized speech and receipt of a closed mouth signal from said switch means.

2. The doll of claim 1, where said central processing unit generates an output signal which causes said motor to be energized upon the commencement of synthesized speech and another output signal which causes said motor to be de-energized when the speech is complete and said mechanism has moved said mouth to a closed position.

* * * * *